US005188537A

United States Patent [19]

Itoh, deceased et al.

[11] Patent Number: 5,188,537

[45] Date of Patent: Feb. 23, 1993

[54] SLIPPAGE PREVENTER FOR AN IGNITION TERMINAL CABLE

[75] Inventors: Hiroyuki Itoh, Mie, Japan, Yuji Kawai, deceased, late of Mie, Japan by Fumio Kawai, legal representative *

[73] Assignee: Sumitomo Wiring Systems, Ltd., Mie, Japan

[21] Appl. No.: 889,468

[22] Filed: May 27, 1992

[30] Foreign Application Priority Data

May 27, 1991 [JP] Japan ..... 47828/91[U]

[51] Int. Cl.[5] ..... H01R 13/44

[52] U.S. Cl. ..... 439/127; 123/169 PH

[58] Field of Search ..... 439/125-130, 439/893; 123/169 PA, 169 PH

[56] References Cited

U.S. PATENT DOCUMENTS 4,790,767 12/1988 Sturdevan et al. .

FOREIGN PATENT DOCUMENTS 1205573 9/1970 United Kingdom ..... 439/125

*Primary Examiner*—Eugene F. Desmond

*Attorney, Agent, or Firm*—Sughrue, Mion, Zinn, Macpeak & Seas

[57] ABSTRACT

A slippage preventer for an ignition cable terminal comprises a holder cap 11 for covering a head of a grommet 3, a holder body 10 having an opening 10*a* into which the grommet is inserted and for covering a lower hanging portion, and locking means provided on the holder body 10 for engaging with a fitting portion provided on said ignition tower so that the holder body is secured to the ignition tower. The holder cap 11 is rotatably supported on the holder body 10. The preventer has a very simple construction and can set a direction of the grommet 3 to be attached to an ignition tower irrespective of the kind of the tower.

1 Claim, 4 Drawing Sheets

SLIPPAGE PREVENTER FOR AN IGNITION TERMINAL CABLE

BACKGROUND OF THE INVENTION

1. Field of the Invention

This invention relates to an improvement of a slippage preventer for an ignition cable terminal, which is mounted on and secured to an ignition tower of an internal combustion engine.

2. Statement of the Prior Art

Heretofore, an ignition cable terminal to be coupled to an ignition distributor for an internal combustion engine such as a conventional engine, and the like has an electrical insulation construction, since a high voltage is applied to the terminal. An example of a construction of a conventional ignition cable terminal will be described below with reference to FIGS. 3 to 8.

FIG. 3 is a side elevational view of a conventional terminal of an ignition cable. FIG. 4 is a perspective view of a conventional ignition distributor body for an internal combustion engine. FIG. 5 is a perspective view of a conventional slippage preventer for an ignition cable terminal. FIG. 6 is a rear side view taken from arrow VI in FIG. 5. FIG. 7 is a fragmentary cross sectional view of a conventional ignition tower in which a conventional terminal of an ignition cable is mounted. FIG. 8 is a similar view taken from arrow VIII in FIG. 7, illustrating another example.

As shown in FIG. 3, an ignition cable terminal 1 comprises a reverse L-shaped grommet (discap) 3 made of rubber for covering an end of an ignition cable 2 and a male terminal member 4 secured to the grommet 3 so that the member is coaxially aligned with a vertical portion of the grommet 3. The end of the ignition cable 2 is connected to the male terminal member 4 in the grommet 3.

On the other hand, a connecting portion of an ignition device for an internal combustion engine, as shown in FIG. 4, has a plurality of ignition towers 6 provided on an upper portion of a distributor body 5 for the internal combustion engine. The male terminal member 4 is connected to a female terminal member provided in the ignition tower 6 by pushing a lower portion of the grommet 3 of the terminal 1 into a connection hole **6*a* in the ignition tower 6. A stepped portion 3*a* at a lower end of the grommet 3 is pressed against the connection hole 6*a* in the ignition tower 6 and the grommet 3 is secured to the ignition tower 6** in an air-tight condition due to the elastomeric grommet.

However, it is insufficient to prevent the grommet 3 from slipping out of the ignition tower 6 only by way of a compression force of the grommet 3. For example, when the ignition cable is interfered with during inspection of the engine, the terminal 1 tends to slip out of the ignition tower. The terminal also slips out of the tower gradually due to vibration of the engine.

In either case, it is impossible to obtain normal ignition, thus leading to melting of a catalyst for purifying exhaust gas. As the ignition cable carries a high voltage, exposure of its terminal can have serious consequences. For example, if a leakage of volatile gas occures, an explosion or fire may result.

Accordingly, heretofore it is necessary to use a slippage preventer which secures the terminal of the ignition cable to the ignition tower.

As shown in FIGS. 5 and 6, a plastic preventer 7 is provided at the rear thereof with a large opening **7*a* for receiving the grommet 3 for the terminal 1 for the ignition cable at the front thereof. The preventer 7 is provided with a locking arm 7*c* having at one end a locking hole 7*b* for receiving a locking projection formed on the ignition tower 6 as mentioned below and a handle 7*d* for releasing the preventer 7 from the ignition tower 6**.

As shown in FIG. 7, the locking projection **6*b* provided on the side of the ignition tower 6 engages with the locking hole 7*b* provided in the preventer 7 so that the head 3*b* of the grommet 3** is secured in the preventer.

The cylindrical female terminal member **6*c*, which is provided in the ignition tower 6 and is contact with the male terminal member 4**, is connected through a lead (not shown) to an igniter of the internal combustion engine.

In the above conventional preventer 7, however, the mounting direction of the preventer depends on the position of the locking projection **6*b* on the tower 6 and the direction of the horizontal portion of the grommet 3**, i.e., the direction of drawing the cable is limited.

In particular, in the distributor body 5 for igniting the internal combustion engine as shown in FIG. 4, since a plurality of ignition towers 6 are arranged in the upper narrow space the terminal must be connected to the ignition tower 6 so that none of the horizontal portions of the grommet 3 are interfered with. As mentioned above, however, it is very difficult to connect the terminal to the tower if the direction of mounting the grommet 3 is limited by the position of the locking projection **6*b***.

Further, since a complicated ignition device requires a delicate adjustment of the direction of drawing the cable, the conventional preventer no longer requires such an arrangement.

In order to overcome this problem, it will be possible to predeterminately set the direction of the locking projection **6*b* so that each of the directions of drawing the cables becomes optimum to each of the ignition towers, respectively. This, however, requires a troublesome machining operation and is unadaptable. It is also possible to provide the preventer 7 with a plurality of locking holes on the periphery thereof and to engage the locking projection 6*b* with a locking hole provided in a suitable direction. This, however, requires provision of a plurality of locking arms 7*c* corresponding to the locking holes 7*b***, causes the preventer to be weakened, and is unadaptable to the fine adjustment of the direction of the cable.

On the other hand, it will be possible to provide the ignition tower 6 with a flared locking projection **6*b*' around the periphery thereof and to provide the preventer 7 with a locking arm 7*f* having at an end a latch 7*e* for engaging with the projection 6*b*'**.

This construction has an advantage in that the direction of mounting is variable since the latch **7*e* can engage with the flared locking projection in any direction. It is very difficult, however, to form the flared locking projection 6*b*' on the whole periphery of the ignition tower 6 under a condition in which a die is used to mold the preventer. The flared locking projection 6*b*'** requires a greater distance than the other preventers described above between the ignition towers, and thus makes it difficult to provide many ignition towers in a narrow space above the distributor.

SUMMARY OF THE INVENTION

An object of the present invention is to provide a slippage preventer for an ignition cable terminal, which has a very simple construction and can set a direction of a grommet to be attached to an ignition tower irrespective of the kind of the tower.

In order to accomplish the above object, a slippage preventer for an ignition cable terminal in accordance with the present invention is a preventer which serves to couple a reverse L-shaped grommet attached to an end of said ignition cable to an ignition tower of an internal combustion engine. The preventer of the present invention comprises:

a holder cap for covering a head of said grommet;

a holder body having an opening into which said grommet is inserted and for covering a lower hanging portion, said holder cap being rotatably supported on said holder body; and locking means provided on said holder body for engaging with a fitting portion provided on said ignition tower so that said holder body is secured to said ignition tower.

In accordance with the present invention, the slippage preventer can set a direction of the grommet to be attached to the ignition tower, since the holder cap for covering the head of the grommet is detachably and rotatably coupled to the holder body for covering the lower hanging portion.

DETAILED DESCRIPTION OF THE PREFERRED EMBODIMENTS

Figure 1:
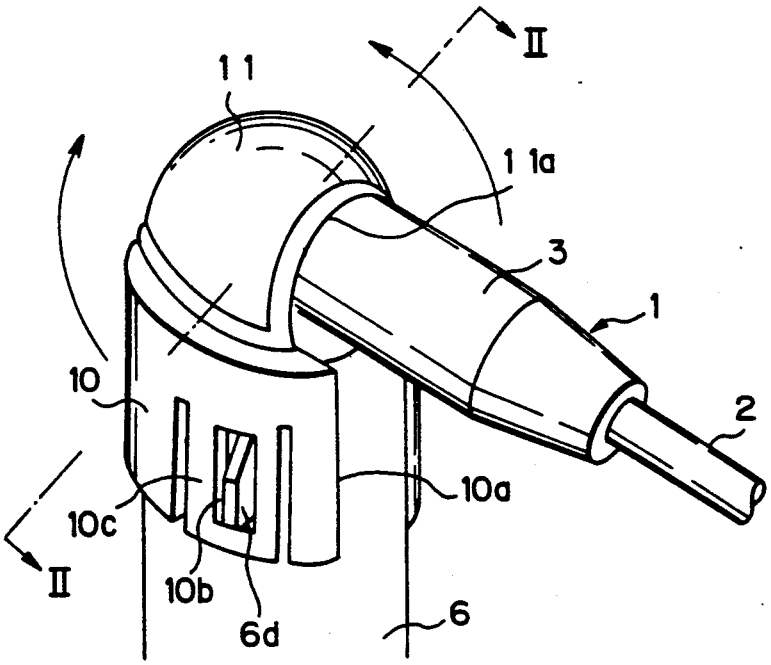
FIG. 1 is a perspective view of an embodiment of a slippage preventer for an ignition cable terminal in accordance with the present invention.
Figure 2:
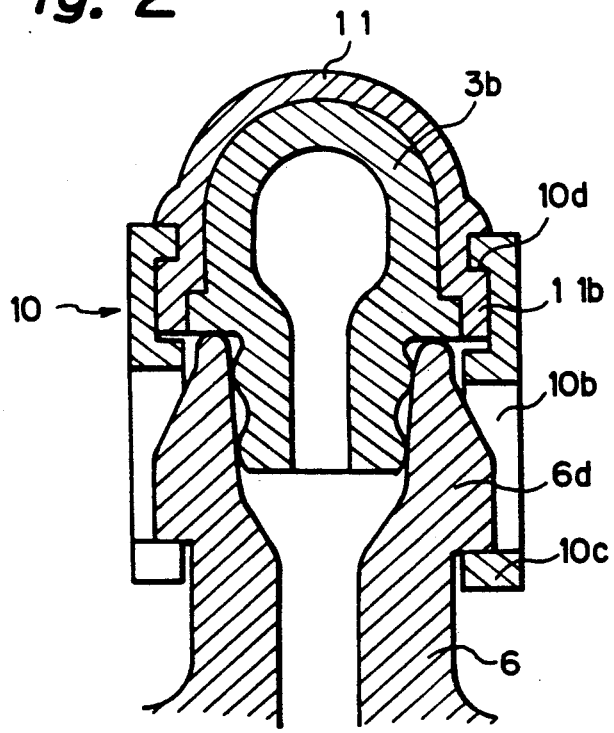
FIG. 2 is a cross sectional view taken along line II—II in FIG. 1.
Figure 3:
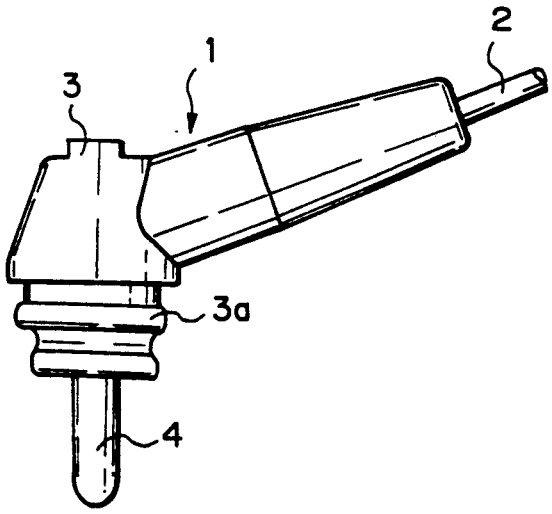
Fig. 3 PRIOR ART
FIG. 3 is a side elevational view of a conventional ignition cable terminal.
Figure 4:
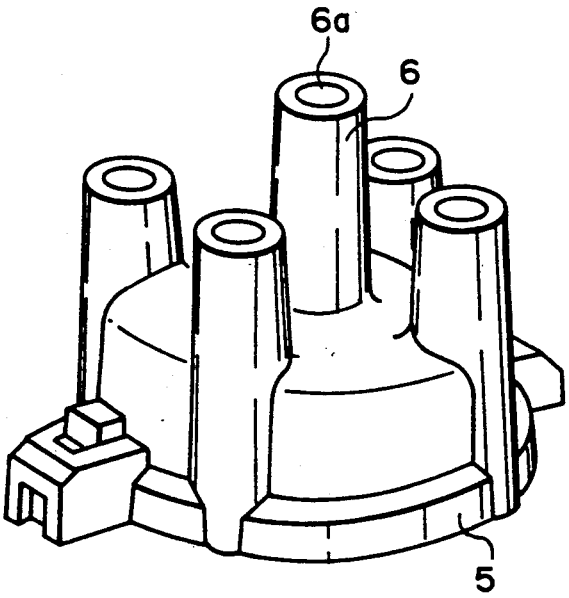
Fig. 4 PRIOR ART
FIG. 4 is a perspective view of a conventional ignition distributor body for an internal combustion engine.
Figure 5:
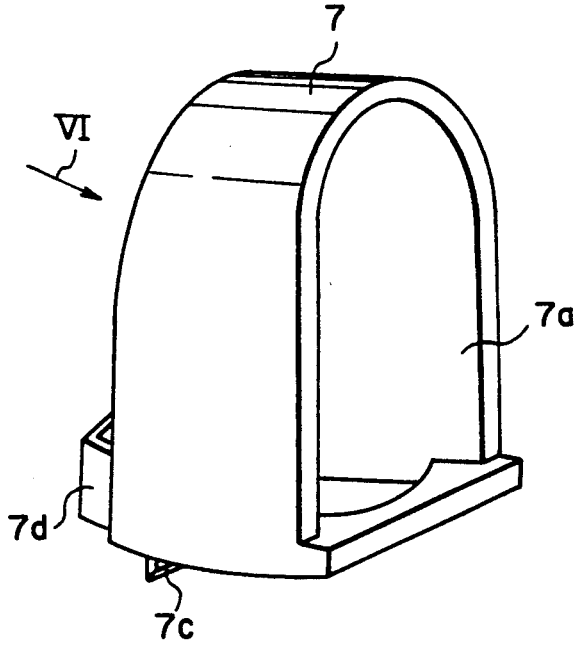
Fig. 5 PRIOR ART
FIG. 5 is a perspective view of a conventional slippage preventer for an ignition cable terminal.
Figure 6:
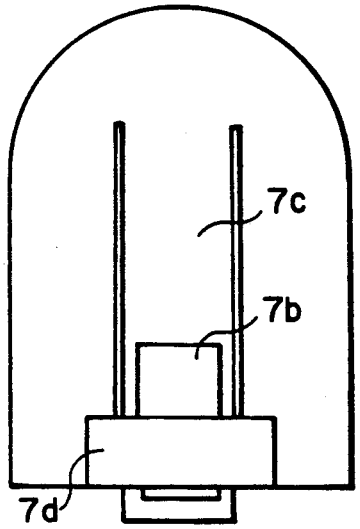
Fig. 6 PRIOR ART
FIG. 6 is a rear side view taken from arrow VI in FIG. 5.
Figure 7:
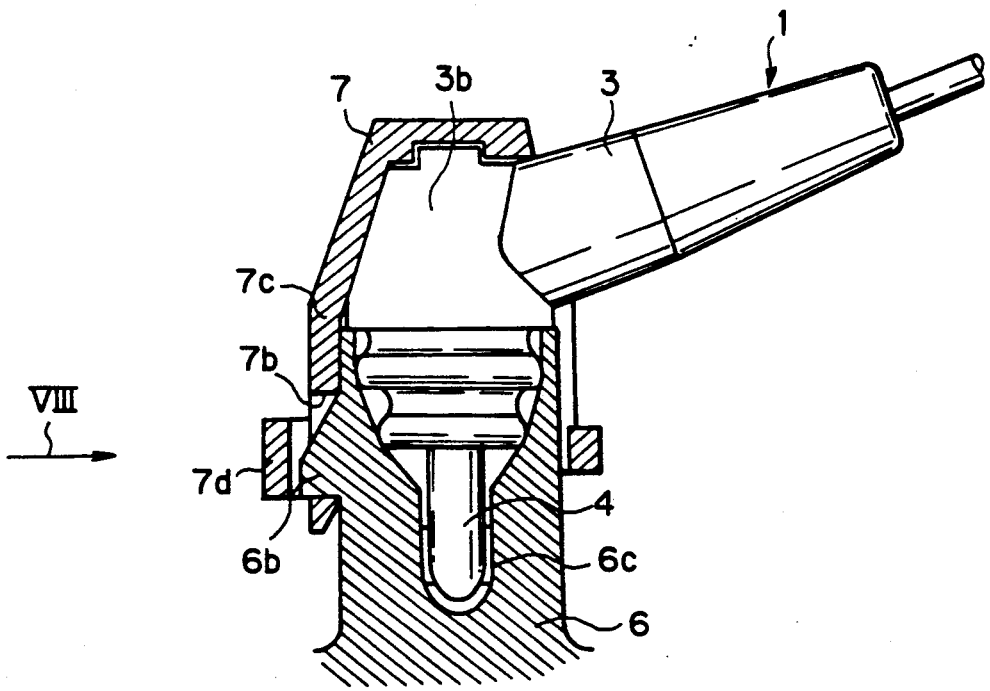
Fig. 7 PRIOR ART
FIG. 7 is a fragmentary cross sectional view of a conventional ignition tower in which a conventional ignition cable terminal is mounted.
Figure 8:
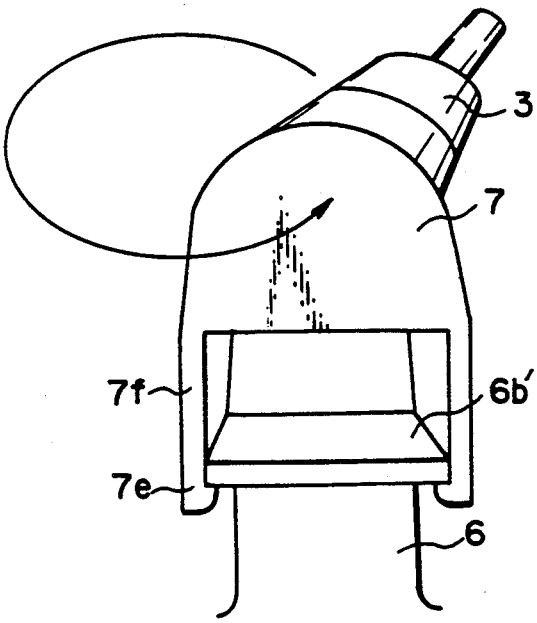
Fig. 8 PRIOR ART
FIG. 8 is a similar view taken from arrow VIII in FIG. 7, illustrating another example.

Referring now to FIGS. 1 and 2, an embodiment of the slippage preventer for the ignition cable terminal will be described below.

In FIG. 1, the terminal 1 for the ignition cable comprises a holder body 10, a holder cap 11 rotatably supported on an upper portion of the holder body 10, and a grommet 3. FIG. 1 is a perspective view of the grommet 3 mounted on an ignition tower 6 through the preventer for the ignition cable terminal 1. The holder cap 11 is provided with an inlet 11*a* for insertion of a horizontal portion of the grommet 3 at the front of the cap.

Also, the holder body 10 is provided with an opening 10*a* for receiving the grommet 3 at the front of the body. The holder body 10 has a locking arm 10*c* with locking holes 10*b* at opposite sides. When the holder body 10 is mounted on the ignition tower 6 as shown in FIG. 2, locking projections 6*d* formed on the exterior of the ignition tower 6 engage with the locking holes 10*b*, respectively so as to secure the grommet 3 to the ignition tower 6.

Such engagement with two opposite sets of locking means can provide a secure connection between the holder body 10 and the ignition tower 6 in comparison with a single set of locking means at the rear side.

The holder body 10 has a circular cross section so that the body 10 can be closely fitted on the ignition tower 6. The holder body 10 is provided with a groove 10*d* at the interior thereof. A projection 11*b* formed on a lower portion of the holder cap 11 is rotatably fitted in the groove 10*d*. Thus, the holder cap 11 is rotatably coupled to the holder body 10. In this case, it is desirable to securely fit the projection 11*b* into the groove 10*d* in order to ensure the attachment of the grommet 3.

The holder cap 11 has an interior which receives a head 3*b* of the grommet 3 so that the grommet 3 can be properly inserted into the ignition tower 6 in the manner outlined below.

A process for mounting the terminal 1 of the ignition cable on the ignition tower 6 by using the preventer of the present invention will be explained below.

First, the holder cap 11 is turned in the holder body 10 so that the inlet 11*a* of the cap 11 is aligned with the opening 10*a* of the body 10. Second, the horizontal portion of the grommet 3 is inserted into the opening 10*a* and the head 3*b* of the grommet 3 is inserted into the interior of the holder body 10 whereby the grommet 3 is mounted in the holder cap 11.

Since the grommet 3 is made of an elastic rubber and the interior of the holder cap 11 has a shape which corresponds to the head 3*b* of the grommet 3, it can be tightly fitted in the holder cap 11.

Then, the holder cap 11 is turned so that the direction for drawing the cable becomes optimum. The locking hole 10*b* of the holder body 10 is aligned with the locking projection 6*d* on the ignition tower 6 and the holder body 10 is pushed onto the ignition tower until the locking projection 6*d* engages with the locking hole 10*b*. If necessary, the holder cap may be turned again to adjust the direction for drawing the cable.

In this case, the holder body 10 is securely fitted on the ignition tower 6 through the locking hole 10*b*. Since as mentioned above, the grommet 3 is surely supported in the holder cap 11, the grommet 3 can be kept in a normal position and the terminal 1 of the ignition cable can be securely connected to the ignition tower.

Preferably, the holder body 10 and the holder cap 11 are made of a plastic resin material having an insulation and easy-forming properties, but they are not necessarily limited to the material.

Also, the present invention is not limited to the above construction in which the holder cap 11 is rotatably mounted on the holder body 10. For example, a projection formed in the interior of the holder body 10 may rotatably engage with a groove formed on a lower periphery of the holder cap 11 or the holder cap 11 may be rotatably mounted on an outer periphery of the holder body.

Further, the present invention is not limited to the above locking means in which the locking projection 6*d* of the ignition tower 6 engages with the locking hole 10*b* of the holder body 10. For example, a locking projection may be formed on the holder body 10 and a locking recess may be formed on the ignition tower 6 to receive the projection. The locking hole 10*b* of the holder body 10 may be altered to a locking pawl to engage with the locking projection 6*d* of the ignition tower 6.

It will be apparent from the foregoing description that in accordance with the present invention the slippage preventer can set a direction of the grommet to be attached to the ignition tower, since the holder cap for covering the head of the grommet is detachably and rotatably coupled to the holder body for covering the lower hanging portion. It is possible to connect the terminal of the ignition cable to the ignition tower in any directions even if a plurality of ignition towers are arranged in a narrow space in the ignition distributor or the like. The preventer of the present invention can be fully adapted to a complicated ignition device which requires a delicate adjustment of angle direction for drawing the cable and thus enables efficient attaching and detaching of the terminal of the ignition cable.

What is claimed is:

1. A slippage preventer for an ignition cable terminal which serves to couple a reverse L-shaped grommet attached to an end of said ignition cable to an ignition tower of an internal combustion engine, comprising:

a holder cap for covering a head of said grommet;

a holder body having an opening into which said grommet is inserted and for covering a lower hanging portion, said holder cap being rotatably supported on said holder body; and locking means provided on said holder body for engaging with a fitting portion provided on said ignition tower so that said holder body is secured to said ignition tower.

* * * * *

UNITED STATES PATENT AND TRADEMARK OFFICE

CERTIFICATE OF CORRECTION

PATENT NO. : 5,188,537

DATED : February 23, 1993

INVENTOR(S) : Hiroyuki Itoh et al.

It is certified that error appears in the above-identified patent and that said Letters Patent is hereby corrected as shown below:

On the title page, item (19), delete "Itoh, deceased et al." and insert --Itoh, et al--.

Signed and Sealed this

First Day of February, 1994

Bruce Lehman

*Attest:*

BRUCE LEHMAN

*Attesting Officer*

*Commissioner of Patents and Trademarks*